US007201463B2

(12) United States Patent
Kosugi et al.

(10) Patent No.: US 7,201,463 B2
(45) Date of Patent: Apr. 10, 2007

(54) CONTAINER FOR PRINTING MATERIAL AND DETECTOR USED FOR CONTAINER

(75) Inventors: Yasuhiko Kosugi, Nagano-ken (JP); Noboru Asauchi, Nagano-ken (JP); Yuichi Nishihara, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 665 days.

(21) Appl. No.: 10/637,437

(22) Filed: Aug. 8, 2003

(65) Prior Publication Data

US 2004/0155913 A1 Aug. 12, 2004

(30) Foreign Application Priority Data

Aug. 12, 2002 (JP) ..... 2002-234263

(51) Int. Cl.
*B41J 29/393* (2006.01)

(52) U.S. Cl. ..... 347/19

(58) Field of Classification Search ..... 347/7, 347/19, 50, 92; 399/36, 37
See application file for complete search history.

(56) References Cited

U.S. PATENT DOCUMENTS 5,500,657 A * 3/1996 Yauchi et al. ..... 347/9
6,938,978 B2 * 9/2005 Kosugi et al. ..... 347/19
6,984,012 B2 * 1/2006 Asauchi ..... 347/19
6,994,415 B2 * 2/2006 Asauchi et al. ..... 347/19
7,011,384 B2 * 3/2006 Kosugi et al. ..... 347/19

FOREIGN PATENT DOCUMENTS

JP 2001-147146 5/2001

* cited by examiner

*Primary Examiner*—Anh T. N. Vo
(74) *Attorney, Agent, or Firm*—Stroock & Stroock & Lavan LLP

(57) ABSTRACT

A cartridge 100 utilizes a carrier wave of a signal transmitted from a printer PT to generate driving electric powers required for driving respective circuits elements including a sensor SS of a piezoelectric element. The generated electric power is supplied to a sensor driving voltage generator 220 and is then to the sensor SS. The sensor driving voltage generator 220 supplies the electric power to the sensor SS via a supply circuit having a higher impedance. The sensor SS is discharged via a discharge circuit having a lower impedance. Even when there is a limited electric power supply, the structure enables the sensor SS to release a large energy in a unit time and ensures a sufficient displacement of vibration in the sensor SS. This arrangement of the invention ensures application of a sufficiently high voltage to the piezoelectric element of he sensor SS and causes a sufficient resonance of the sensor SS, even when a cartridge communicating with a printing device receives only a small electric power supply.

11 Claims, 5 Drawing Sheets

CONTAINER FOR PRINTING MATERIAL AND DETECTOR USED FOR CONTAINER

BACKGROUND OF THE INVENTION

1. Field of the Invention

The present invention relates to a container for printing material that is attached to a printing device and holds a printing material therein, as well as to a technique of detecting a status of the printing material held in such a container.

2. Description of the Related Art

Diverse containers of printing materials used for printing devices have been proposed; for example, ink cartridges for ink jet printers and toner cartridges for laser printers and photocopiers. There is a requirement to detect the status of the printing material held in such a container for appropriate management of the printing material. One known technique measures the status of ink remaining in the container (for example, the residual quantity of ink or the temperature, the viscosity, or the pressure of ink) and uses the measurement result to manage the ink level in the cartridge or regulate the size of ink droplets. Various detection elements are applicable for such measurement. A technique of using a piezoelectric element for a sensor that measures a residual quantity of ink is one example (Patent Laid-Open Gazette 2001-147146). The piezoelectric element is distorted under application of a voltage. The known technique utilizes such distortion to generate a vibration. The technique places a piezoelectric element to face a cavity and observes a variation in frequency or a resonance due to a vibration induced by a distortion of the piezoelectric element to detect the quantity of ink remaining in the cartridge. The printing device establishes communication with the cartridge to obtain the remaining quantity of ink detected by the sensor. A contact-type communication system that brings the cartridge in electrical contact with the printing device or a non-contact type communication system that utilizes a radio wave is applicable for communication between the cartridge and the printing device.

The magnitude of the induced vibration depends upon the degree of distortion of the piezoelectric element. A low given voltage and a small degree of distortion may thus cause an insufficient vibration, which results in malfunction of the sensor. The cartridge communicating with the printing device by the non-contact communication system does not receive a direct supply of electric power from the printing device. The electric power for driving the sensor is thus to be produced by electromagnetic induction of the received radio wave. The prior art cartridge can, however, generate only a small electric power through the electromagnetic induction and has difficulties in actuation of the sensor that requires application of a relatively high voltage. This problem of insufficient power supply arises even in a container equipped with a battery as part of the power source, when the electric power consumed by the sensor exceeds the electric power supplied from the battery.

This problem is not restricted to the ink cartridge for holding ink therein, but is also found in various cartridges and containers for holding printing materials, for example, a toner cartridge.

SUMMARY OF THE INVENTION

The object of the present invention is thus to solve the problem of the prior art technique and to allow for accurate detection of the status of a printing material by utilizing a phenomenon induced by release of energy in discharge of a detection element, which is provided in a container for holding the printing material.

In order to attain at least part of the above and the other related objects, the present invention is directed to a technique that utilizes a detection element provided in a container for holding a printing material to detect a status of the printing material. Electrical energy is supplied to the detection element via a supply circuit, which has a preset impedance. The detection element is discharged to release electrical energy accumulated therein via a discharge circuit, which has a lower impedance than the impedance of the supply circuit. The status of the printing material is detected by utilizing a phenomenon induced by release of energy in the discharge of the detection element.

The detection technique of the invention sets the higher impedance of the supply circuit for supplying electrical energy to the detection element than the impedance of the discharge circuit for discharging the detection element to release electrical energy accumulated in the detection element. This arrangement effectively reduces an electric power per unit time required for detection of the status of the printing material, while increasing the electrical energy released per unit time in the discharge. A large electrical energy can thus be released from the detection element in the discharge time, so as to enhance the detection accuracy of the status of the printing material. The container for the printing material may be freely attachable to and detachable from a printing device, or may alternatively be fixed to the printing device in an undetachable manner. The container may allow or prohibit refill of the printing material.

One application of this detection technique is a container for printing material, which holds a printing material therein and is mounted on a printing device. The container includes: a detector module that utilizes a phenomenon induced by release of energy in discharge of a detection element to detect a status of the printing material; and a driving circuit that functions to drive the detector module. The driving circuit includes: a discharge circuit that has a preset impedance and discharges the detection element to release electrical energy accumulated in the detection element; and a supply circuit that has a higher impedance than the impedance of the discharge circuit and supplies electrical energy to the detection element.

These and other objects, features, aspects, and advantages of the present invention will become more apparent from the following detailed description of the preferred embodiment with the accompanying drawings.

DESCRIPTION OF THE PREFERRED EMBODIMENTS

One mode of carrying out the invention is discussed below as a preferred embodiment in the following sequence:

A. General Structure of Cartridge

B. Electrical Structure of Cartridge

C. Circuit Structure of Residual Ink Quantity Detector

D. Ink Level Determination Routine

E. Effects

F. Modifications

A. General Structure of Cartridge

Figure 1:
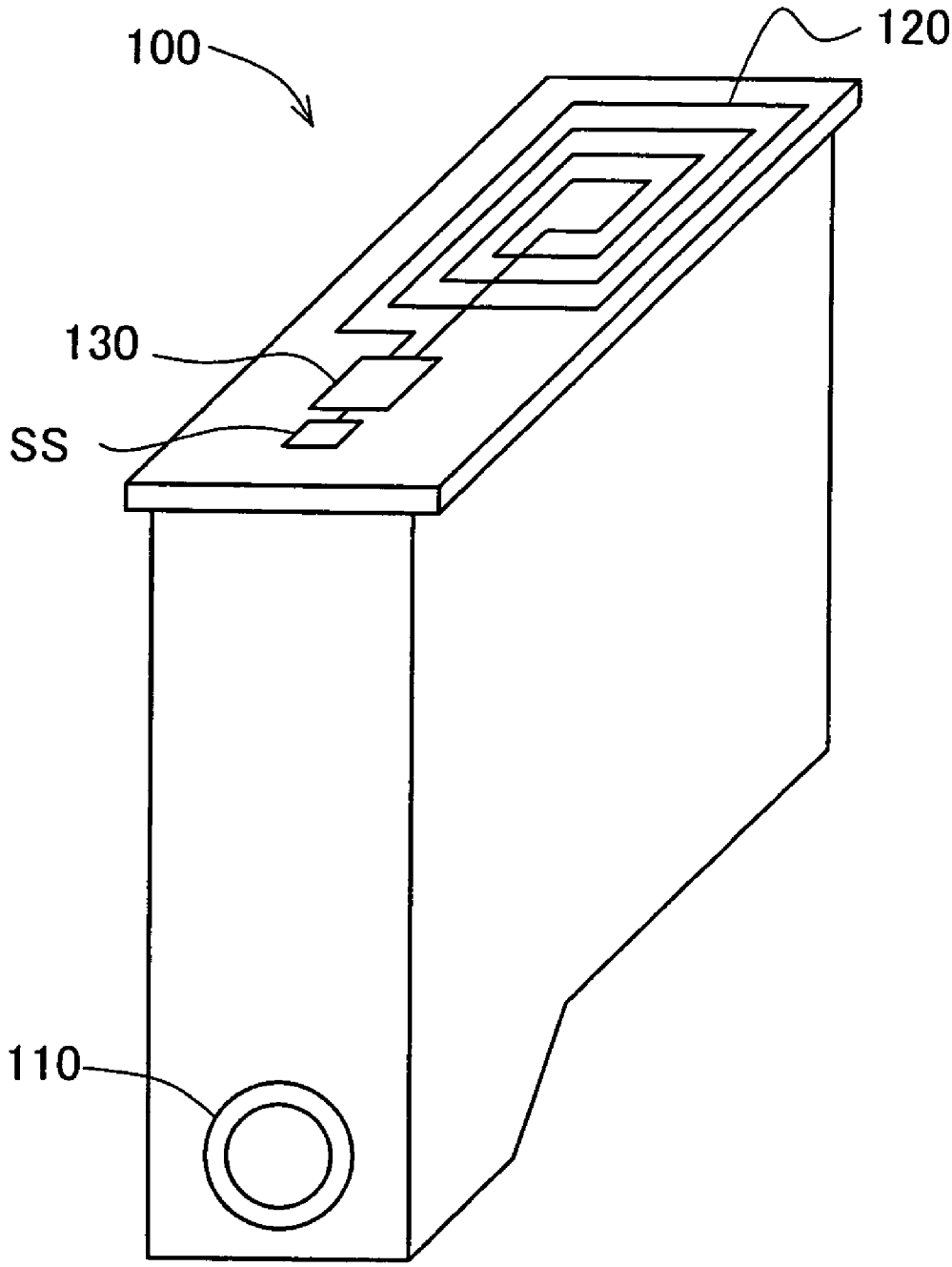
FIG. 1 is a perspective view illustrating the appearance of a cartridge in one embodiment of the invention.

FIG. 1 is a perspective view illustrating the appearance of a cartridge 100 in one embodiment of the invention. An ink supply opening 110 is formed in the lower portion of the cartridge 100 to feed a supply of ink to a print head in a printer. The top face of the cartridge 100 has an antenna 120 for wireless communication with the printer, a sensor SS used to measure a residual quantity of ink, and a logic circuit 130.

In the structure of this embodiment, a piezoelectric element is used for the sensor SS. The cartridge 100 radiates an elastic wave, which is produced by vibrating the piezoelectric element of the sensor SS, onto an ink liquid surface and measures a back electromotive force as a resultant of its reflected wave and the remaining vibration, so as to determine the ink level.

B. Electrical Structure of Cartridge

Figure 2:
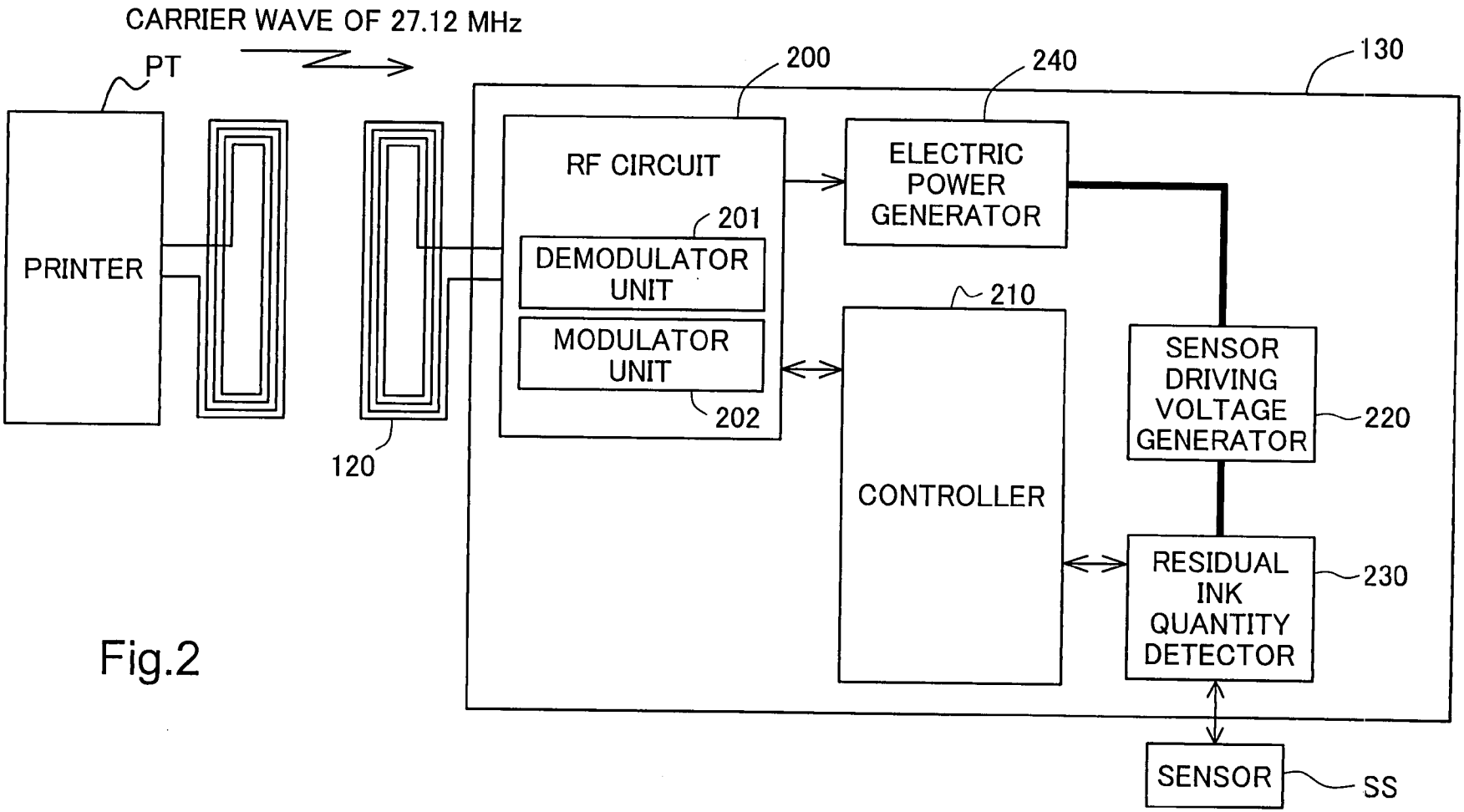
FIG. 2 is a block diagram showing the structure of a logic circuit included in the cartridge of FIG. 1.

FIG. 2 is a block diagram showing the structure of the logic circuit 130 included in the cartridge 100. The logic circuit 130 includes an RF circuit 200, a controller 210, a sensor driving voltage generator 220, a residual ink quantity detector 230, and an electric power generator 240.

The RF circuit 200 includes a demodulator unit 201 that demodulates radio waves received from a printer PT via the antenna 120, and a modulator unit 202 that modulates input signals from the controller 210 and transmits the modulated signals to the printer PT. The printer PT generates a carrier wave of 27.12 MHz, makes the carrier wave subjected to ASK modulation, and transmits the ASK-modulated carrier wave as control signals to the cartridge 100. The ASK modulation varies the amplitude of the carrier wave in response to digital Commands and data to be sent back from the controller 210 to the printer PT, on the other hand, undergo PSK modulation by the modulator unit 202, prior to transmission. The PSK modulation varies the phase of the carrier wave in response to digital signals. The printer PT and the cartridge 100 communicate with each other in this manner. The modulation systems described here are only illustrative, and other modulation systems may be applicable according to the requirements.

The controller 210 carries out various control operations according to the control signals demodulated by the demodulator unit 201. The control operations include, for example, transmission of a detection signal to the residual ink quantity detector 230 to detect the ink level.

The electric power generator 240 rectifies the carrier wave received by the RF circuit 200 to generate an electric power having a voltage of 5 V. The electric power generator 240 is connected with the RF circuit 200 and the controller 210 and is used as an electric power supply for driving these circuit elements, although connection lines are omitted from the illustration of FIG. 2. As shown by a line in FIG. 2, the sensor driving voltage generator 220 is connected with the electric power generator 240.

The sensor driving voltage generator 220 generates a voltage required for driving the sensor SS. Application of any voltage to accumulate electric charges distorts the piezoelectric element by electrostriction effects, while discharge to release the accumulated electric charges eliminates the distortion and results in free vibration of the piezoelectric element. The sensor SS takes advantage of the free vibration of the piezoelectric element to detect the residual ink level. The strength of the vibration is proportional to the magnitude of the applied voltage. The structure of the embodiment thus uses a high voltage of approximately 18 V to vibrate the piezoelectric element. For this purpose, a boosting-type charge pump is applied for the sensor driving voltage generator 220. In the case where a single charge pump has an insufficient output voltage, combination of multiple charge pumps may be applied for the sensor driving voltage generator 220. Any of diverse boosting-type DC/DC converters, such as a switching regulator, may also be applicable for the sensor driving voltage generator 220.

C. Circuit Structure of Residual Ink Quantity Detector

Figure 3:
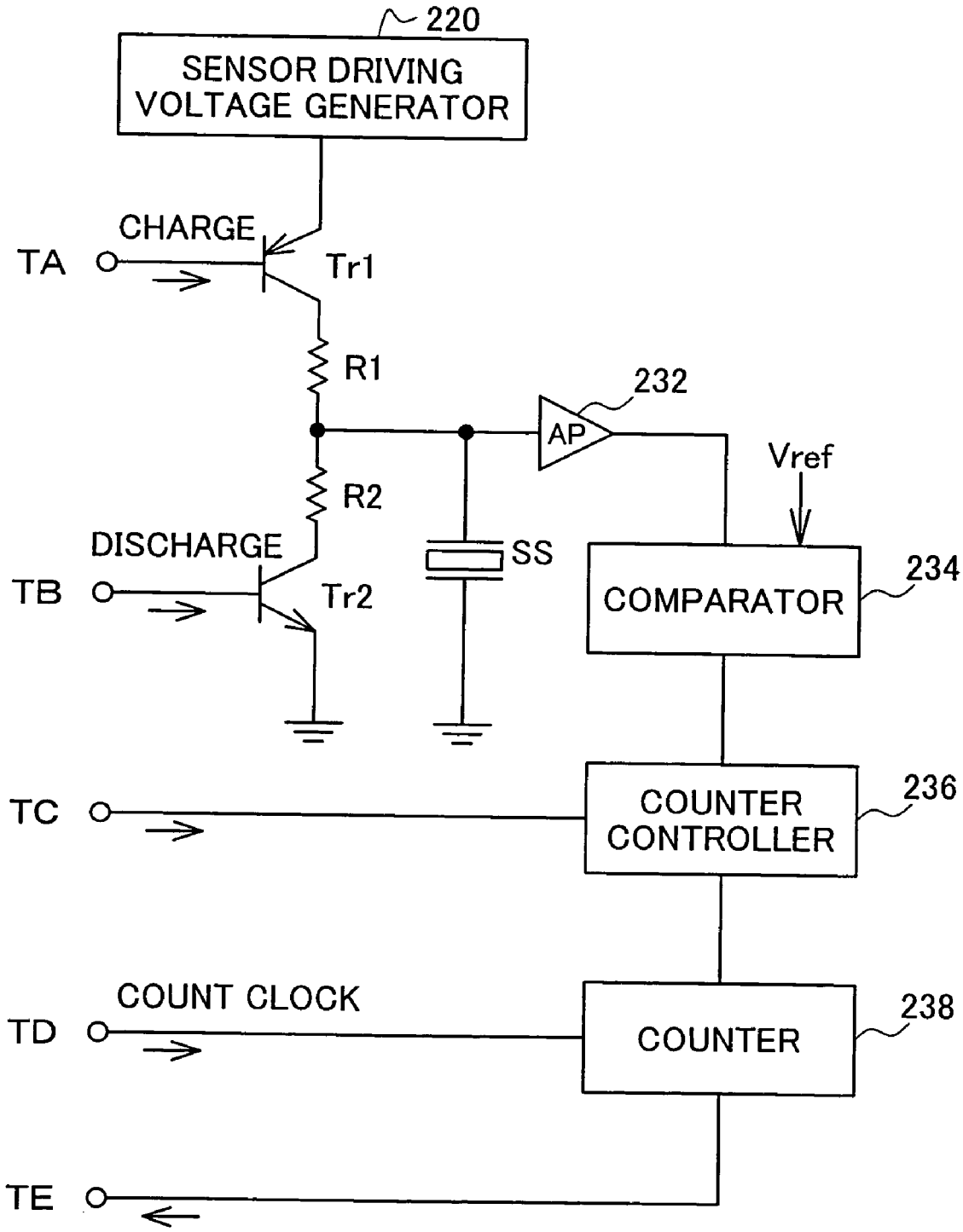
FIG. 3 is a circuit diagram showing the structure of a residual ink quantity detector included in the logic circuit of FIG. 2.

FIG. 3 shows the circuit structure of the residual ink quantity detector 230. The residual ink quantity detector 230 includes two transistors Tr1 and Tr2, two resistors R1 and R2, an amplifier 232, a comparator 234, a counter controller 236, a counter 238, and an oscillator (not shown). The residual ink quantity detector 230 also has a terminal TA for inputting a charge signal from the controller 210 into the transistor Tr1, a terminal TB for inputting a discharge signal into the transistor Tr2, a terminal TC for inputting a signal into the counter controller 236, a terminal TD for inputting a count clock from the oscillator into the counter 238, and a terminal TE for outputting a resulting count on the counter 238 to the controller 210.

The transistor Tr1 is a PNP transistor and has a base connecting with the terminal TA, an emitter connecting with the sensor driving voltage generator 220, and a collector connecting with the sensor SS via the resistor R1. The transistor Tr2 is, on the other hand, an NPN transistor and has a base connecting with the terminal TB, a collector connecting with the sensor SS via the resistor R2, and a grounded emitter. Since the two transistors Tr1 and Tr2 are respectively the PNP transistor and the NPN transistor, a fall of the terminal TA to a low level turns ON the transistor Trn, while a rise of the terminal TB to a high level turns ON the transistor Tr2. For convenience of explanation, TA and TB may represent the charge signal and the discharge signal respectively input into the terminals TA and TB.

One end of the sensor SS is connected to the amplifier 232 as well as to a joint between the resistor R1 and the resistor R2, whereas the other end of the sensor SS is grounded. The resistors R1 and R2 are respectively linked with the sensor driving voltage generator 220 and with a grounding line via the transistors Tr1 and Tr2. The sensor SS is accordingly charged with a supply of electric energy from a supply circuit including the sensor driving voltage generator 220, the transistor Tr1, and the resistor R1 and is discharged by a discharge circuit including the resistor R2, the transistor Tr2, and the grounding line. The amplifier 232 is further joined with the comparator 234. An output terminal of the comparator 234 is connected to the counter controller 236, and an output terminal of the counter controller 236 is connected to the counter 238. An output terminal of the counter 238 is connected to the terminal TE.

The resistor R1 used for charging has a greater resistance than the resistor R2 used for discharging. A resistance r1 of the resistor R1 and a resistance r2 of the resistor R2 are specified as discussed below. Accumulation of electric charges in the sensor SS using the piezoelectric element causes a mechanical distortion of the piezoelectric element by electrostriction effects. Discharge of the accumulated electric charges in this state eliminates the distortion in proportion to the magnitude of energy released per unit time, so as to cause a vibration of the sensor SS. This vibration is utilized for the detection. A minimum possible value is set to the resistance r2 to maximize the energy released per unit time. An impedance rd of the discharge circuit is not equal to 0, because of the presence of an ON resistance of the transistor Tr2. The resistor R2 may thus be omitted (r2=0). The supply of electrical energy to the sensor SS (that is, charging via the transistor Tr1) is eventually restricted by the quantity of energy output per unit time by the sensor driving voltage generator 220. Even when a circuit resistance rc of the supply circuit is reduced, the internal resistance of the sensor driving voltage generator 220 limits the supply of electric current. The circuit resistance rc of the supply circuit to the sensor SS is designed to satisfy an equation of:

$$rc=V/\text{imax}$$

where V denotes an output voltage of the sensor driving voltage generator 220 and imax denotes an upper limit of electric current taken out of the sensor driving voltage generator 220 without any difficulties.

The resistance r1 of the resistor R1 is specified from this circuit resistance rc as:

$$R1=rc\ rON\ rr$$

where rON denotes an ON resistance of the transistor Tr1 and rr denotes a wiring resistance the circuit.

In the structure of this embodiment, the impedance rc of the supply circuit and the impedance rd of the discharge circuit has a relation of:

$$rc>rd.$$

This causes the energy supplied per unit time from the sensor driving voltage generator 220 to be significantly smaller than the energy released per unit time in the discharge process. The technique of accumulating the energy required for detection by the sensor SS over a relatively long time and releasing the accumulated energy in a short time enables the sensor driving voltage generator 220 having a small energy supply capacity to induce the resonance sufficient for detection in the sensor SS.

Figure 4:
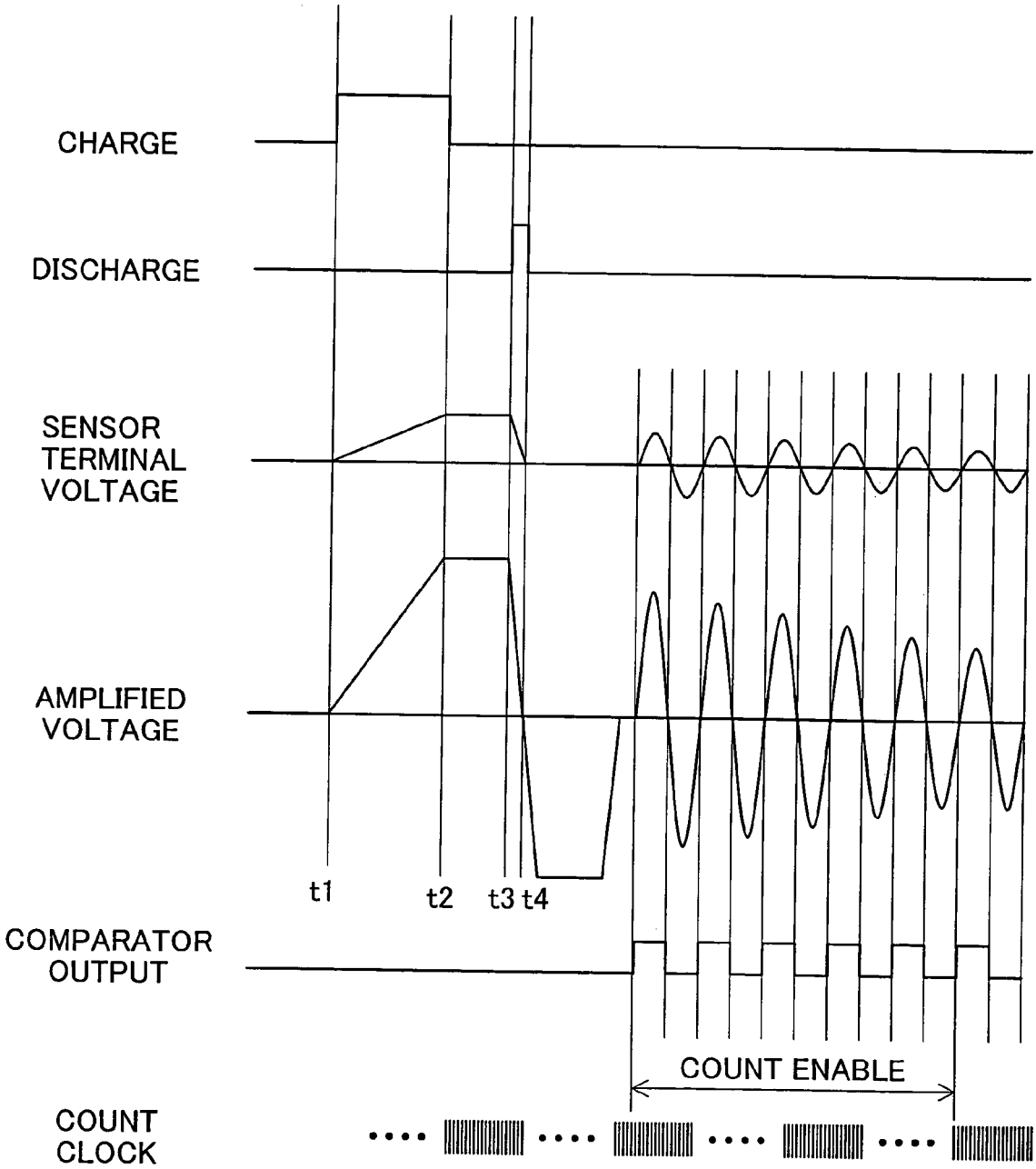
FIG. 4 is a timing chart in a circuit constituting the residual ink quantity detector.

The operations of the above circuit structure are discussed below with reference to the timing chart of FIG. 4. In the initial state, the charge signal TA and the discharge signal TB are both at the high level to set the transistor Tr1 in the OFF state and the transistor Tr2 in the ON state. No electric charges are thus accumulated in the sensor SS grounded via the transistor Tr2. When the sensor SS is driven for measurement, the controller 210 first drops the discharge signal TB to the low level to turn the transistor Tr2 OFF and subsequently drops the charge signal TA to the low level at a time point t1 to turn the transistor Tr1 ON. For a time period between time points t1 and t2, the voltage generated by the sensor driving voltage generator 220 is applied onto the sensor SS via the resistor R1 to accumulate electric charges in the sensor SS. The terminal voltage of the sensor SS thus gradually increases to the level of the voltage generated by the sensor driving voltage generator 220. Since the sensor SS is charged via the resistor R1, the energy accumulated per unit time is less than the energy released per unit time by the discharge via the resistor R2. The waveform of the terminal voltage of the sensor SS accordingly has a gentler gradient in the charge time than a gradient in the discharge time as shown in the timing chart of FIG. 4. This charges the sensor SS to accumulate the electrical energy, while accumulating the mechanical distortion in the sensor SS by electrostriction effects. The sensor SS is accordingly deformed.

The controller 210 raises the charge signal TA to the high level at a time point t2 to turn the transistor Tr1 OFF and raises the discharge signal TB to the high level at a time point t3 to turn the transistor Tr2 ON. The transistor Tr2 is kept ON for a time period between time points t3 and t4 to release the electric charges accumulated in the sensor SS via the resistor R2. In order to prevent the two transistors Tr1 and Tr2 from being set simultaneously in the ON state, the structure of this embodiment has a time period between time points t2 and t3 to set both the transistors Tr1 and Tr2 OFF.

The discharge releases all the mechanical distortion, which has been accumulated in the sensor SS in the charge time, and deforms the sensor SS. The sensor SS is then free from application of any voltage and falls into a state that allows for free vibration. The vibration energy remaining in the sensor SS causes free vibration of the sensor SS at a resonance frequency of its cavity. The free vibration also deforms the sensor SS and generates a voltage between the terminals of the sensor SS. The variation in voltage is amplified by the amplifier 232 and is output to the comparator 234. The comparator 234 compares the amplified voltage variation with a predetermined reference voltage Vref, specifies a result of the comparison as either a high-level signal or a low-level signal, and outputs the specified high-level or low-level signal to the counter controller 236. The counter controller 236 receives the input signal from the terminal TC and generates a counter control signal to validate the operation of the counter 238 for a time period corresponding to 5 pulses of the output signal from the comparator 234 since a start of the resonance vibration of the piezoelectric element. The counter 238 counts the number of pulses in the count clock input from the terminal TD, while the count control signal is at the high level (in the count enable state). The resulting count on the counter 238 is transmitted to the controller 210 and then to the printer PT. The printer PT calculates the vibration frequency of the sensor SS from the resulting count on the counter 238 and thereby determines the level of ink remaining in the cartridge 100.

D. Ink Level Determination Routine

Figure 5:
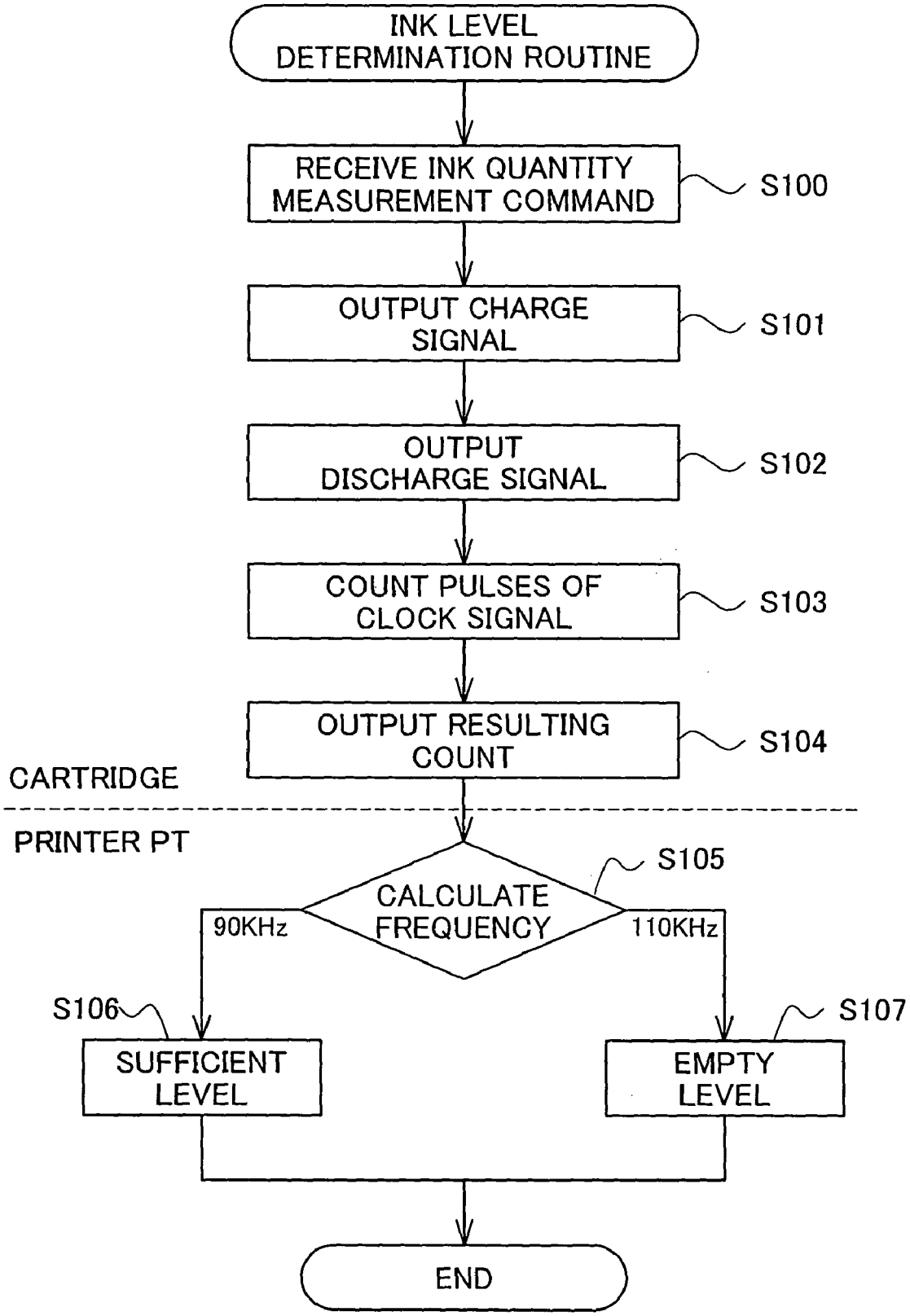
FIG. 5 is a flowchart showing an ink level determination routine executed by a controller included in the logic circuit of FIG. 2.

FIG. 5 is a flowchart showing an ink level determination routine, which includes a series of processing executed by the cartridge 100 and a series of processing executed by the printer PT. The controller 210 of the cartridge 100 receives an ink quantity measurement command from the printer PT via the RF circuit 200 (step S100) and outputs the charge signal to the residual ink quantity detector 230 in response to the ink quantity measurement command (step S101). After elapse of a preset time period, the controller 210 outputs the discharge signal (step S102) and activates the counter 238 of the residual ink quantity detector 230 to count the number of pulses in the count clock (step S103). The controller 210 outputs the resulting count to the printer PT via the RF circuit 200 (step S104). In the printer PT, the oscillator included in the residual ink quantity detector 230 has a known oscillation frequency. The printer PT calculates the vibration frequency of the sensor SS from the resulting count and determines the status of the remaining ink in the cartridge 100 according to the calculated vibration frequency (step S105). The printer PT specifies a sufficient level of ink at the frequency of 90 KHz (step S106), while specifying a substantially empty level of ink at the frequency of 110 KHz (step S107). This series of processing determines the residual level of ink in the cartridge 100.

E. Effects

As described above, in the structure of the embodiment, the resistor used for charging has a higher setting of resistance, whereas the resistor used for discharging has a lower setting of resistance. This ensures supply of an electric power sufficient for induction of the resonance, while reducing the electric power per unit time supplied to the sensor SS. The discharge releases a large quantity of energy in a short time period. This causes a sufficiently large vibration of the sensor SS and thus enables the residual quantity of ink to be detected accurately by taking advantage of the vibration of the sensor SS.

F. Modifications

The cartridge 100 of the embodiment may have a memory unit, in which diverse pieces of information on the cartridge 100 are stored. In this modified structure, it is preferable that information regarding the production number and the production date of the cartridge 100 and the type of ink filled in the cartridge 100 is stored in advance in the memory unit. An EEPROM, for example, is applicable for the memory unit. In the ink level determination routine of the embodiment, the resulting count representing the status of remaining ink is transmitted to the printer PT at step S104. Simultaneously with or in place of the processing at step S104, the resulting count may be written into the memory unit in the case where the cartridge 100 is detached from one printer and is attached to another printer, this modified arrangement informs another printer of the status of remaining ink without re-measurement of the ink quantity.

The cartridge 100 of the embodiment may have a memory voltage generator, which supplies an electric power to the memory unit by utilizing the electric power generated by the electric power generator 240, in addition to the sensor driving voltage generator 220. Even when the voltage required for writing data into the memory unit is different from the voltage required for driving the sensor SS, this modified structure ensures efficient production of the respective required electric powers.

In another modified structure, the sensor driving voltage generator 220 may also function as a second electric power generator for supplying the required electric power to the memory unit. This simplifies the circuit structure of the cartridge.

The above embodiment regards application of the invention to the ink cartridge that holds the ink therein. The ink cartridge is, however, not restrictive at all, but the technique of the invention may be applicable to a toner cartridge that holds a toner therein or in general to a container for holding a printing material therein.

The controller 210 actualized by the hardware construction in the above embodiment may be attained by the software configuration. For example, the controller 210 may be replaced by a microcomputer including a CPU, a ROM, and a RAM. In the structure of the embodiment, the ink level is determined by the series of processing executed by both the cartridge 100 and the printer PT. The ink level may, however, be determined by a series of processing executed by only the cartrdige 100.

In the structure of the embodiment, the electric power consumed in the cartridge 100 is generated by the radio wave for communication. One modified structure sets a small-sized button battery in the cartridge 100 and drives the sensor SS with the electric power of the battery. In this modified structure, the impedance of the supply circuit for supplying the electric power is set higher than the impedance of the discharge circuit. This reduces the electric power per unit time in the charge time, thus allowing for use of the small battery and lengthening the estimated usable time of the battery.

The embodiment detects the residual quantity of ink as the status of the printing material. The object of detection is, however, not restricted to the residual quantity of ink. The status of the printing material to be detected may be, for example, the temperature, the humidity, the density, the mass, the viscosity, or the pressure of the printing material. The variation of the property, such as the temperature, the humidity, or the density of the printing material is related to the variation in resonance frequency.

In the structure of the embodiment, the impedances of the circuits are adjusted by regulating the resistances alternatively be applied for adjustment of the impedances. One applicable technique uses the ON resistances of the transistors Tr1 and Tr2 for the adjustment. Another technique uses a coil component to adjust the impedances by taking into account the charge and discharge time (frequency) of the sensor SS.

The embodiment discussed above and its modified examples are to be considered in all aspects as illustrative and not restrictive. There may be many other modifications, changes, and alterations without departing from the scope or spirit of the main characteristics of the present invention. For example, the whole or part of the antenna 120 and the logic circuit 130 may be constructed as a one-chip system LSI.

The scope and spirit of the present invention are indicated by the appended claims, rather than by the foregoing description.

What is claimed is:

1. A container for printing material, which holds a printing material therein and is mounted on a printing device, said container comprising:

a detector module that senses energy released from a discharge of a piezoelectric element to detect a property of the printing material;

a driving circuit that drives said detector module, said driving circuit comprising; a discharge circuit that has a first impedance and discharges the detection element to release electrical energy accumulated in the detection element, and a supply circuit that has a second impedance that is higher than the first impedance and supplies electrical energy to the detection element; and a power supply unit to drive said detector module, where an electric power output of said power supply unit is less than an electric power output of the piezoelectric element through said discharge circuit.

2. A container for printing material in accordance with claim 1, wherein discharge of the piezoelectric element subsequent to charge of the piezoelectric element in said driving circuit causes a resonance, and said detector module detects the property of the printing material according to a frequency of the resonance.

3. A container for printing material in accordance with claim 1, said container further comprising a receiver module that receives an externally input radio wave, wherein said power supply unit comprises:

an electric power generator that generates an electric power from the radio wave received by said receiver module; and an electric power supplier that supplies the generated electric power to said driving circuit.

4. A container for printing material in accordance with claim 3, wherein said receiver module is provided as part of a communication module that transmits data including information on the detected status of the printing material to and from said printing device.

5. A container for printing material in accordance with claim 1, wherein said power supply unit is a battery set in said container.

6. A container for printing material in accordance with claim 1, wherein said driving circuit comprises a booster circuit that boosts a voltage of the supplied power source and uses the boosted voltage as a power source of said supply circuit.

7. A container for printing material in accordance with claim 1, wherein the detected status of the printing material is a remaining quantity of the printing material.

8. A container for printing material in accordance with claim 1, wherein the detected status of the printing material is one of temperature, humidity, density, mass, viscosity, and pressure of the printing material.

9. A container for printing material, which holds a printing material therein and is mounted on a printing device, said container comprising:

a detector module that senses energy released from a discharge of a piezoelectric element to detect a property of the printing material; and a driving circuit that drives said detector module, said driving circuit comprising; a charge circuit that charge said detection element, and a discharge circuit that discharges an electric energy accumulated in the detection element, wherein a charging period by said charge circuit is longer than a discharging period by said discharge circuit, and wherein an electric power output of said charge circuit is smaller than an electric power output of said discharge circuit.

10. A detector for printing material, which uses a detection element provided in a container for holding a printing material to detect a property of the printing material, said detector comprising:

a supply circuit that has a preset impedance and supplies electrical energy to the detection element;

a discharge circuit that has a lower impedance than the impedance of said supply circuit and discharges the detection element to release electrical energy accumulated in the detection element; and a detector module that senses energy released from a discharge of a piezoelectric element to detect the property of the printing materials, wherein an electric power output of said supply circuit is smaller than an electric power output of said discharge circuit.

11. A method of detecting a property of a printing material with a detection element provided in a container for holding the printing material, said method comprising the steps of:

supplying electrical energy to the detection element via a supply circuit, which has a preset impedance;

discharging the detection element to release electrical energy accumulated in the detection element via a discharge circuit, which has a lower impedance than the impedance of said supply circuit; and sensing energy released from a discharge of a piezoelectric element to detect the property of the printing materials, wherein an electric power output of said supply circuit is smaller than an electric power output of said discharge circuit.

* * * * *